US011187137B2

(12) United States Patent
Tada

(10) Patent No.: US 11,187,137 B2
(45) Date of Patent: Nov. 30, 2021

(54) CYLINDER BLOCK

(71) Applicant: TOYOTA JIDOSHA KABUSHIKI KAISHA, Aichi-ken (JP)

(72) Inventor: Hiroshi Tada, Mishima (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 17/200,903

(22) Filed: Mar. 15, 2021

(65) Prior Publication Data

US 2021/0317771 A1 Oct. 14, 2021

(30) Foreign Application Priority Data

Apr. 14, 2020 (JP) ..... JP2020-072321

(51) Int. Cl.
*F02B 75/18* (2006.01)
*F01P 3/02* (2006.01)
*F01P 3/00* (2006.01)

(52) U.S. Cl.
CPC ..... *F01P 3/02* (2013.01); *F01P 2003/001* (2013.01); *F01P 2003/021* (2013.01)

(58) Field of Classification Search
CPC .. F01P 3/02; F01P 2003/021; F01P 2003/028; F02F 1/14; F02B 75/20
USPC ..... 123/41.74
See application file for complete search history.

(56) References Cited

U.S. PATENT DOCUMENTS 4,590,894 A * 5/1986 Ishida ..... F01P 3/02 123/41.74
4,700,665 A * 10/1987 Kanda ..... F02F 1/40 123/41.82 R
6,343,574 B1 * 2/2002 Leonard ..... F02F 1/38 123/41.82 R
2009/0266315 A1 * 10/2009 Hanai ..... F02F 1/14 123/41.72
2015/0159540 A1 * 6/2015 Misumi ..... F01P 3/02 123/41.44
2015/0345363 A1 * 12/2015 Marutani ..... F02F 1/166 123/41.44
2015/0377114 A1 * 12/2015 Matsumoto ..... F01P 3/20 123/41.44
2017/0342939 A1 * 11/2017 Araki ..... F01P 3/02

FOREIGN PATENT DOCUMENTS

JP 2002115600 A * 4/2002
JP 2002115600 A 4/2002
JP 20088195 A 1/2008

* cited by examiner

*Primary Examiner* — Long T Tran
*Assistant Examiner* — James J Kim
(74) *Attorney, Agent, or Firm* — Hauptman Ham, LLP

(57) ABSTRACT

A water jacket of a cylinder block includes a main passage and a sub-passage. The main passage is formed along the periphery of a cylinder bank, and extends between a plurality of head bolt bosses and the cylinder bank. The sub-passage is formed at a position spaced from the cylinder bank farther than the main passage, to diverge from the main passage at a first position, and join the main passage at a second position downstream of the first position. A first head bolt boss by which coolant flowing from a coolant inlet initially passes is interposed between the main passage and the sub-passage. The first position is located between the first head bolt boss and the coolant inlet. The second position is located between a second head bolt boss by which the coolant passes next, and the first head bolt boss.

4 Claims, 2 Drawing Sheets

CYLINDER BLOCK

CROSS-REFERENCE TO RELATED APPLICATION

This application claims priority to Japanese Patent Application No. 2020-072321 filed on Apr. 14, 2020, incorporated herein by reference in its entirety.

BACKGROUND

1. Technical Field

The disclosure relates to a cylinder block, and particularly to a cylinder block of a water-cooled multicylinder engine.

2. Description of Related Art

In a cylinder block of a multicylinder engine, a water jacket is formed so as to surround a cylinder bank. Also, in the cylinder block, a plurality of head bolt bosses for receiving head bolts is formed on the exhaust side and the intake side, respectively, along the cylinder bank. The water jacket is formed so that coolant passes through between the head bolt bosses and the cylinder bank, and flows along the periphery of the cylinder bank. One example of a cylinder block in which a water jacket is formed so as to circumvent head bolt bosses is disclosed in Japanese Unexamined Patent Application Publication No. 2008-8195 (JP 2008-8195 A).

In the meantime, as the flow velocity of coolant that flows through the water jacket increases, a pressure loss increases. It is desirable to increase a passage width of the water jacket, so as to reduce the flow velocity of the coolant and thus reduce the pressure loss. However, since the head bolt bosses are formed close to cylinders, locally narrowed portions are produced in the water jacket in the vicinity of the head bolt bosses, even if the passage width of the water jacket is to be increased. Although it is desirable to make the passage width between each cylinder and the corresponding head bolt boss large, the head bolt boss cannot be largely displaced or moved away from the cylinder, in view of the sealing properties and vibration. Namely, the presence of the head bolt bosses impedes reduction of the pressure loss of the coolant. The flow velocity of the coolant introduced into the water jacket is larger as it is measured closer to the coolant inlet; therefore, the head bolt boss that is closest to the coolant inlet on a path of the coolant has a particularly large influence on the pressure loss.

SUMMARY

This disclosure provides a cylinder block that can reduce a pressure loss of coolant that flows through a water jacket.

A cylinder block according to one aspect of the disclosure includes a cylinder bank having a plurality of cylinders arranged in series, a water jacket configured to surround the cylinder bank, a coolant inlet from which a coolant is introduced into the water jacket, and a plurality of head bolt bosses formed along the cylinder bank. The water jacket includes a main passage and a sub-passage. The main passage is formed along a periphery of the cylinder bank, and extends between the head bolt bosses and the cylinder bank. The sub-passage is formed at a position spaced from the cylinder bank farther than the main passage, to diverge from the main passage at a first position, and join the main passage at a second position located downstream of the first position. A first head bolt boss as one of the head bolt bosses, by which the coolant flowing from the coolant inlet into the main passage initially passes, is interposed between the main passage and the sub-passage. The first position is located between the first head bolt boss and the coolant inlet. The second position is located between a second head bolt boss by which the coolant passes next after passing by the first head bolt boss, and the first head bolt boss.

As described above, the presence of the head bolt bosses impedes reduction of the pressure loss of the coolant. In particular, the first head bolt boss is located close to the coolant inlet, and the flow velocity of the coolant is large in the vicinity of the coolant inlet; therefore, the presence of the first head bolt boss has a large influence on the pressure loss of the coolant. However, in the cylinder block configured as described above, the coolant introduced from the coolant inlet into the water jacket is divided into a stream of coolant flowing in the main passage and a stream of coolant flowing in the sub-passage, at the first position, and these streams join together at the second position after passing by the first head bolt boss. Thus, a part of the coolant flows between the cylinder bank and the first head bolt boss, and the remaining coolant flows on the rear side of the first head bolt boss as viewed from the cylinder bank, so that the cross-sectional area of flow channels around the first head bolt boss can be increased. As a result, the flow velocity of the coolant in the vicinity of the first head bolt boss can be reduced, and the pressure loss of the coolant when it passes by the first head bolt boss can be reduced.

The coolant inlet may be located between a third head bolt boss and the first head bolt boss. The third head bolt boss is located on one side of the first head bolt boss opposite to the second head bolt boss. With this arrangement, the flow of the coolant introduced from the coolant inlet into the water jacket is prevented from hitting the head bolt boss straight, and thereby stagnating on the rear side of the head bolt boss as viewed from the coolant inlet.

The main passage may be formed such that the coolant flowing from the coolant inlet flows in one direction. For example, the main passage may include an intake-side passage formed along an intake-side wall of the cylinder bank, an exhaust-side passage formed along an exhaust-side wall of the cylinder bank, and a connecting passage that connects the intake-side passage with the exhaust-side passage, in one end portion of the cylinder bank. In this case, the coolant inlet may be connected to the intake-side passage. The first head bolt boss may be formed on an intake side of the cylinder bank between a first cylinder that is closest to the other end portion of the cylinder bank, and a second cylinder that is second closest to the other end portion. The first cylinder and the second cylinder are included in the cylinders of the cylinder bank. With this arrangement, it is possible to curb stagnation of coolant flow, which would take place when the coolant that has passed by the first head bolt boss through the main passage, and the coolant that has passed by the first head bolt boss through the sub-passage, hit against each other.

The water jacket may include a widened portion having a larger width than the main passage downstream of the first position, between the coolant inlet and the first position, and the sub-passage may be integrated with the widened portion. With this arrangement, it is possible to further reduce the flow velocity of the coolant from the time when the coolant is introduced from the coolant inlet into the water jacket, to the time when it passes by the first head bolt boss, and further reduce the pressure loss of the coolant when it passes by the first head bold boss.

As described above, with the cylinder block according to the disclosure, the flow velocity of the coolant is reduced in the vicinity of the first head bolt boss by which the coolant flowing from the coolant inlet into the main passage initially passes, so that the pressure loss of the coolant flowing in the water jacket can be reduced.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
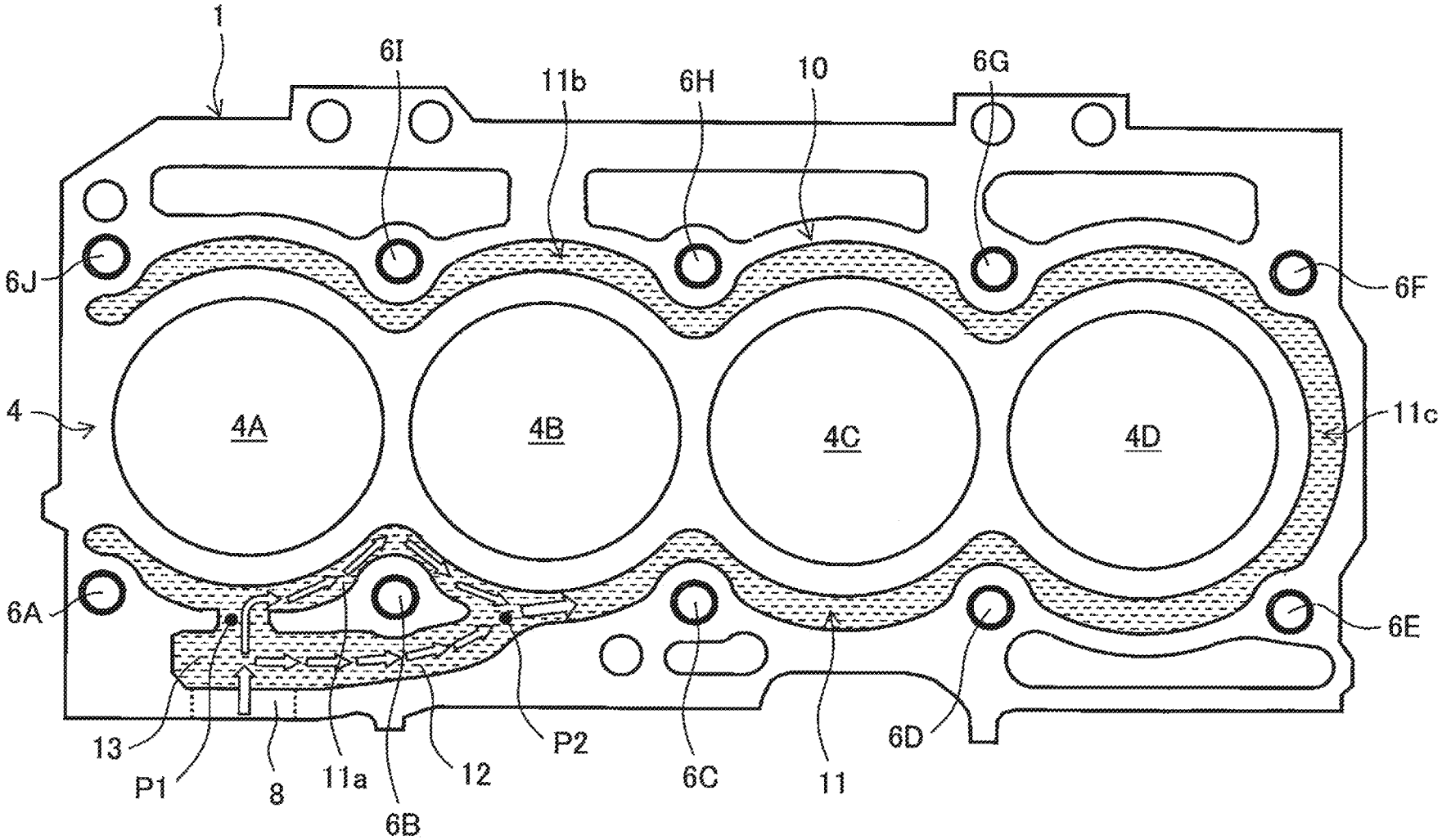
FIG. 1 is a top view of a cylinder block according to a first embodiment of the disclosure.

Referring to the drawings, embodiments of the disclosure will be described. The embodiments indicated below are provided for illustrating devices or methods for specifying the technical concept of the disclosure, but are not intended to limit the structures and locations of constituent components, the order of process steps, and so forth, to those as described below, except when particularly clearly specified. The disclosure is not limited to the embodiments indicated below, but may be embodied with various modifications, without departing from the principle of the disclosure.

First Embodiment

The structure of a cylinder block according to a first embodiment of the disclosure will be described. FIG. 1 is a top view of the cylinder block 1 according to this embodiment. The cylinder block 1 is a cylinder block of a straight-four engine. In the cylinder block 1, four cylinders, i.e., first cylinder 4A, second cylinder 4B, third cylinder 4C, and fourth cylinder 4D, are formed side by side at equal intervals. In the following description, the cylinders 4A to 4D will be generally called "cylinder bank 4". However, this disclosure may also be applied to a cylinder block having a cylinder bank of three cylinders or six cylinders, other than four cylinders, provided that it is a cylinder block having a cylinder bank in which two or more cylinders are arranged side by side. The disclosure may also be applied to a cylinder block of an engine, such as a V-type engine or a horizontally opposed engine, having two or more cylinder banks.

The cylinder block 1 has an open deck structure, and a water jacket 10 that surrounds the cylinder bank 4 is fully open to a deck surface. Also, the deck surface is formed with head bolt bosses 6A to 6J that receive head bolts for mounting a cylinder head onto the cylinder block 1. The head bolt bosses 6A to 6J are located at substantially equal intervals so as to surround the cylinder bank 4, such that five bosses are provided for each of the exhaust side and the intake side relative to the cylinder bank 4. In FIG. 1, the lower side is the intake side, and the upper side is the exhaust side. Also, the side on which power is taken out from a crankshaft will be called "front side" of the cylinder block 1, and the opposite side will be called "rear side". In FIG. 1, the right-hand side is the front side, and the left-hand side is the rear side. This disclosure may also be applied to a cylinder block having a closed deck structure.

The water jacket 10 is a generally U-shaped water jacket in which coolant flows in one direction, from the intake side to the exhaust side, via the front side of the cylinder block 1. A coolant inlet 8 for introducing the coolant into the water jacket 10 is formed in an intake-side side face of the cylinder block 1. The position at which the coolant inlet 8 is formed is set such that the coolant is introduced toward between the head bolt boss 6A located on the outer side of the first cylinder 4A, and the head bolt boss 6B located between the first cylinder 4A and the second cylinder 4B.

The water jacket 10 includes a main passage 11, a sub-passage 12, and a widened portion 13. The main passage 11 is formed along walls of the cylinder bank 4, so as to circumvent the head bolt bosses 6A to 6J. More specifically, the main passage 11 consists of an intake-side passage 11*a*, an exhaust-side passage 11*b*, and a connecting passage 11*c*. The intake-side passage 11*a* passes interspace between the intake-side head bolt bosses 6A to 6E and the cylinder bank 4, and is formed along an intake-side wall of the cylinder bank 4. The coolant inlet 8 communicates with the intake-side passage 11*a*. The exhaust-side passage 11*b* passes interspace between the exhaust-side head bolt bosses 6F to 6J and the cylinder bank 4, and is formed along an exhaust-side wall of the cylinder bank 4. The connecting passage 11*c* is formed along a front wall of the cylinder bank 4, and connects the intake-side passage 11*a* with the exhaust-side passage 11*b*.

The sub-passage 12 is formed at a position spaced from the cylinder bank 4 farther than the intake-side passage 11*a*, such that the head bolt boss 6B is interposed between the sub-passage 12 and the intake-side passage 11*a*. The head bolt boss 6B is one (first head bolt boss) of the head bolt bosses 6A to 6J, by which the coolant flowing from the coolant inlet 8 into the intake-side passage 11*a* initially passes. The head bolt boss 6C located between the second cylinder 4B and the third cylinder 4C is a head bolt boss (second head bolt boss) by which the coolant passes next, after passing by the head bolt boss 6B. The sub-passage 12 diverges from the intake-side passage 11*a* at a first position P1 located between the head bolt boss 6B and the coolant inlet 8, and joins the intake-side passage 11*a* at a second position P2 between the head bolt boss 6B and the head bolt boss 6C.

The widened portion 13 is a coolant introduction passage formed between the coolant inlet 8 and the first position P1, and has a larger width than the intake-side passage 11*a*. The widened portion 13 is integrated with the sub-passage 12, and extends in a direction substantially perpendicular to the direction of flow of the coolant introduced from the coolant inlet 8. A part of the coolant introduced from the coolant inlet 8 passes the first position P1, and flows into the intake-side passage 11*a*. The remaining coolant passes through the sub-passage 12 integrated with the widened portion 13, and joins the coolant flowing through the intake-side passage 11*a*, at the second position P2.

Next, the effect of the structure of the cylinder block 1 will be described. The coolant introduced from the coolant inlet 8 into the water jacket 10 is divided into a stream of coolant that flows in the intake-side passage 11*a* and a stream of coolant that flows in the sub-passage 12, at a point upstream of the head bolt boss 6B, and these streams join together after passing by the head bolt boss 6B. Namely, a part of the coolant flows between the cylinder bank 4 and the head bolt boss 6B, and the remaining coolant flows on the rear side of the head bolt boss 6B as viewed from the cylinder bank 4. With the two passages thus formed, the flow velocity of the coolant around the head bolt boss 6B is reduced, and a pressure loss of the coolant when it passes by the head bolt boss 6B is kept low or reduced.

Also, the coolant inlet 8 is not located in front of the head bolt boss 6B as viewed from the intake side of the cylinder block 1, but is located between the head bolt boss 6A and the head bolt boss 6B. The head bolt boss 6A is a head bolt boss (third head bolt boss) that is located on the side opposite to the direction of flow of the coolant from the coolant inlet 8. When the flow of the coolant introduced from the coolant inlet 8 hits a head bolt boss straight, stagnation may arise in the flow on the rear side of the head bolt boss as viewed from the coolant inlet 8. However, when the coolant inlet 8 is formed so as not to be aligned with the head bolt boss 6B, as in the above structure, the flow of the coolant introduced from the coolant inlet 8 can be prevented from hitting the head bolt boss 6B straight.

Furthermore, the widened portion 13 having a larger width than the intake-side passage 11*a* is provided between the coolant inlet 8 and the first position P1. With the widened portion 13 thus provided in the vicinity of the coolant inlet 8, the flow velocity of the coolant introduced from the coolant inlet 8 into the water jacket 10 is reduced. Also, since the widened portion 13 is integrated with the sub-passage 12, a large amount of coolant flows through the sub-passage 12, and the flow velocity of the coolant that passes through the intake-side passage 11*a* and passes by the head bolt boss 6B is reduced.

Second Embodiment

Figure 2:
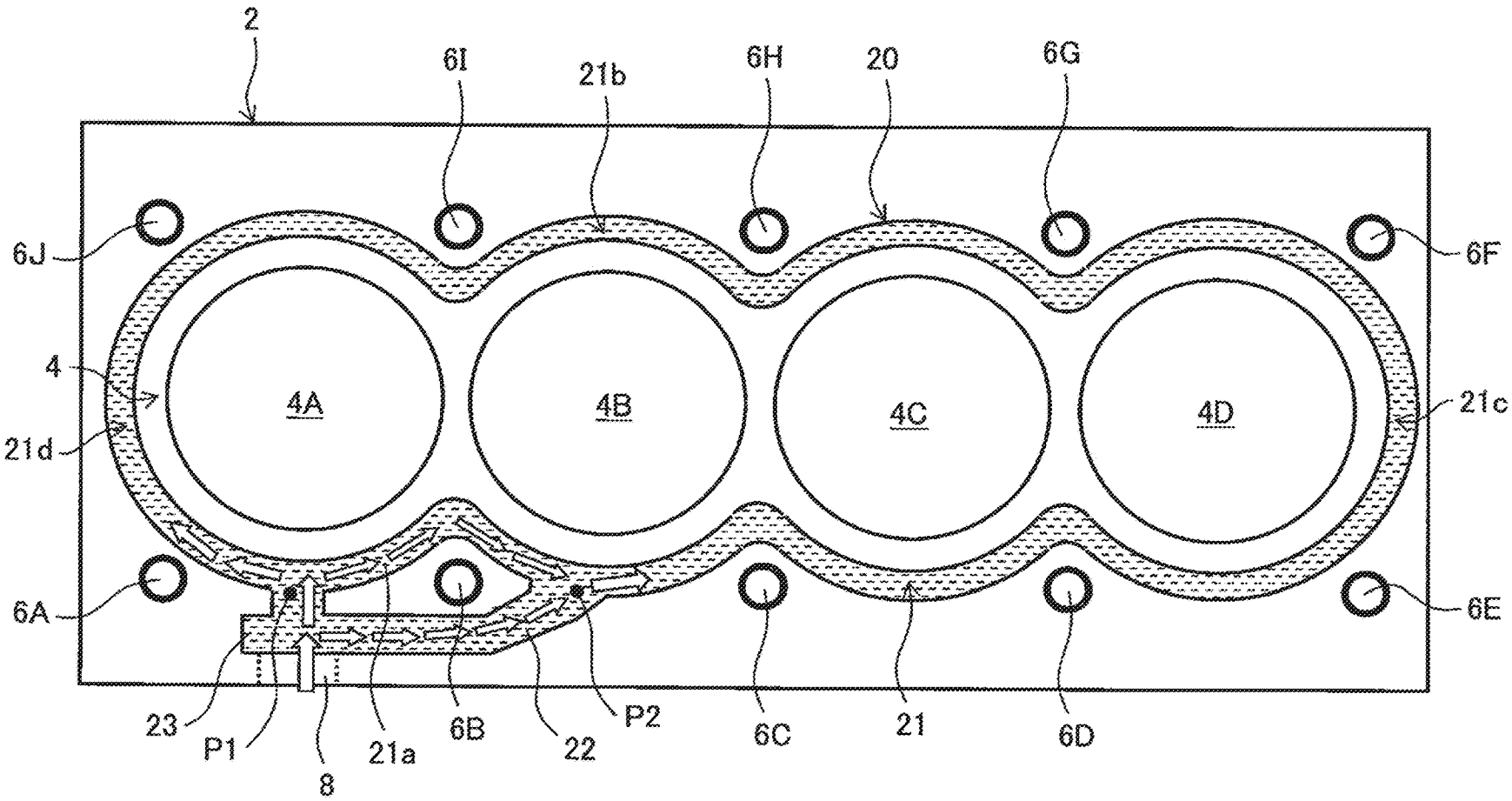
FIG. 2 is a top view of a cylinder block according to a second embodiment of the disclosure.

Next, the structure of a cylinder block according to a second embodiment of the disclosure will be described. FIG. 2 is a top view of the cylinder block 2 according to this embodiment. In FIG. 2, the same reference signs are assigned to components and portions common to the cylinder block 1 according to the first embodiment and the cylinder block 2. In FIG. 2, the structure of the cylinder block 2 is simplified and illustrated.

The cylinder block 2 according to this embodiment is different from the cylinder block 1 according to the first embodiment in terms of the structure of a water jacket 20. In this embodiment, the water jacket 20 is formed such that coolant introduced from the coolant inlet 8 flows in two directions. More specifically, the water jacket 20 includes an annular main passage 21 that surrounds the cylinder bank 4, a sub-passage 22, and a widened portion 23. The main passage 21 consists of an intake-side passage 21*a*, an exhaust-side passage 21*b*, and connecting passages 21*c*, 21*d*. The connecting passage 21*c* is formed along a front wall of the cylinder bank 4, and connects the intake-side passage 21*a* with the exhaust-side passage 21*b*. The connecting passage 21*d* is formed along a rear wall of the cylinder bank 4, and connects the intake-side passage 21*a* with the exhaust-side passage 21*b*. The coolant introduced from the coolant inlet 8 into the intake-side passage 21*a* is divided into a stream directed toward the connecting passage 21*c*, and a stream directed toward the connecting passage 21*d*, at a point between the head bolt boss 6B and the head bolt boss 6A.

The sub-passage 22 diverges from the intake-side passage 21*a* at the first position P1, and joins the intake-side passage 21*a* at the second position P2, such that the head bolt boss 6B is interposed between the sub-passage 22 and the intake-side passage 21*a*. Also, the widened portion 23 is formed between the coolant inlet 8 and the first position P1. The widened portion 23 is integrated with the sub-passage 22. A part of the coolant introduced from the coolant inlet 8 passes through the sub-passage 22 integrated with the widened portion 23, and joins coolant that flows toward the connecting passage 21*c* through the intake-side passage 21*a*, at the second position P2. With the sub-passage 22 thus provided, the flow velocity of the coolant in the vicinity of the head bolt boss 6B is reduced, and the pressure loss of the coolant when it passes by the head bolt boss 6B is kept low or reduced.

As a modified example of the second embodiment, a sub-passage may be formed with respect to the head bolt boss 6A. Namely, in addition to the passage that extends between the head bolt boss 6A and the cylinder bank 4, a coolant passage that passes the rear side of the head bolt boss 6A as viewed from the cylinder bank 4 may be formed.

What is claimed is:

1. A cylinder block comprising:

a cylinder bank having a plurality of cylinders arranged in series;

a water jacket configured to surround the cylinder bank;

a coolant inlet from which a coolant is introduced into the water jacket; and a plurality of head bolt bosses formed along the cylinder bank, wherein the water jacket includes a main passage that is formed along a periphery of the cylinder bank, and extends between the head bolt bosses and the cylinder bank, and a sub-passage that is formed at a position spaced from the cylinder bank farther than the main passage, to diverge from the main passage at a first position, and join the main passage at a second position located downstream of the first position, wherein a first head bolt boss as one of the head bolt bosses, by which the coolant flowing from the coolant inlet into the main passage initially passes, is interposed between the main passage and the sub-passage, and wherein the first position is located between the first head bolt boss and the coolant inlet, and the second position is located between a second head bolt boss by which the coolant passes next after passing by the first head bolt boss, and the first head bolt boss.

2. The cylinder block according to claim 1, wherein the coolant inlet is located between the first head bolt boss, and a third head bolt boss that is located on one side of the first head bolt boss opposite to the second head bolt boss.

3. The cylinder block according to claim 1, wherein:

the main passage includes an intake-side passage formed along an intake-side wall of the cylinder bank, an exhaust-side passage formed along an exhaust-side wall of the cylinder bank, and a connecting passage that connects the intake-side passage with the exhaust-side passage, in one end portion of the cylinder bank;

the coolant inlet is connected to the intake-side passage; and the first head bolt boss is formed on an intake side of the cylinder bank between a first cylinder that is closest to the other end portion of the cylinder bank, and a second cylinder that is second closest to the other end portion, the first cylinder and the second cylinder being included in the cylinders of the cylinder bank.

4. The cylinder block according to claim 1, wherein:

the water jacket includes a widened portion having a larger width than the main passage downstream of the first position, between the coolant inlet and the first position; and the sub-passage is integrated with the widened portion.

* * * * *